US005215353A

United States Patent [19]

Daniel et al.

[11] Patent Number: 5,215,353

[45] Date of Patent: Jun. 1, 1993

[54] THREE-DIMENSIONALLY ADJUSTABLE FULCRUM SUPPORT AID FOR EASY CHAIRS

[76] Inventors: Michael H. Daniel, 3007 Highview La., Mound, Minn. 55364; Lee R. Lindquist, 8956 Northwood Pkwy., New Hope, Minn. 55427

[21] Appl. No.: 767,673

[22] Filed: Sep. 30, 1991

[51] Int. Cl.[5] ..... A47C 7/54

[52] U.S. Cl. ..... 297/411; 297/414; 297/DIG. 10

[58] Field of Search ..... 297/445, 411, 416, 414, 297/DIG. 10, 42, 43, 5, 136, 153, 160, 161, 170, 171, 172, 174; 248/118, 118.1

[56] References Cited

U.S. PATENT DOCUMENTS

| | | | |
|---|---|---|---|
| 2,113,882 | 4/1938 | Galt | 297/411 |
| 2,468,856 | 5/1949 | Alexander | 297/136 |
| 2,551,999 | 5/1951 | Ditty, Sr. . | |
| 2,642,117 | 6/1953 | Glauber | 297/414 |
| 2,773,542 | 12/1956 | Chasin | 297/411 |
| 2,903,714 | 9/1959 | Grondona | 297/411 |
| 3,206,249 | 9/1965 | Gateley | 297/416 |
| 3,215,382 | 11/1965 | Stein . | |
| 4,196,480 | 4/1980 | Guenther et al. . | |
| 4,595,235 | 6/1986 | Leib | 297/411 X |

*Primary Examiner*—Kenneth J. Dorner
*Assistant Examiner*—Joanne Bonifanti
*Attorney, Agent, or Firm*—Schroeder & Siegfried

[57] ABSTRACT

A three dimensionally adjustable frame designed to surround an easy chair having abbreviated armrests and providing a fulcrum support against which a user of the chair may bear and pivot about to aid in arising therefrom. The adjustable frame includes inter-engaging slidebar members which provide slideable adjustment thereof. The top portion of the adjustable frame carries a pair of fulcrum support members which extend outwardly from and in front of the front end of each armrest of the easy chair, thereby providing a bearing surface and fulcrum grip which the user of the chair can grasp to aid oneself when arising therefrom.

21 Claims, 4 Drawing Sheets

THREE-DIMENSIONALLY ADJUSTABLE FULCRUM SUPPORT AID FOR EASY CHAIRS

BACKGROUND OF THE INVENTION

Our invention relates generally to supporting devices for aiding the physically handicapped, elderly and childbearing women in arising from a sitting position in a conventional easy chair. Although our invention can be used with most any type of easy chair, it is primarily adapted for use with easy chairs having abbreviated or shortened armrests.

A substantial number of easy chairs, which are sold today, have relatively short armrests. As a result thereof, physically handicapped and elderly people, as well as childbearing women, are often put under considerable stress when seeking to arise from such chairs. Normally, when one arises from such a chair, they place their hands on the ends of the armrests and push downwardly in order to facilitate their movement to an erect position. Such easy chairs, with relatively short armrests, offer considerable difficulty because the center of gravity of the person's body is well ahead of his or her hands, with the result that there is considerable stress on the arms of the individual sitting in the chair.

We have found that the length of armrests generally fall within the range of 11 to 28 inches, and most armchairs today have a setback distance from the front of the seat cushion to the front of the armrest which ranges between 0 to 10 inches. On the average, the setback distance for armchairs today is approximately 4 to 5 inches.

The greater the setback distance is from the front of the seat cushion to the front of the armrests, the more difficult it is for such an encumbered individual to rise from the chair. To provide maximum support for such a person, it is important for the person's hands to bear against a surface which is positioned near or in front of the person's center of gravity as that person moves to an erect position. Since a person's center of gravity is generally positioned over their feet as they stand, it follows that the optimum position for such a bearing surface is near or slightly ahead of the front of the seat cushion of the chair, where the user's feet will be situated when arising from the chair. In view thereof, whenever the terms "abbreviated armrest" or "shortened armrest" are hereinafter used, it is intended to mean that such armrests terminate short of the front end of the seat cushion of the chair with which reference is being made.

With such chairs being prevalent in today's society, there has developed a distinct need for a means of aiding such encumbered individuals in arising therefrom, without destroying the aesthetic appeal which the furniture offers. As such, it is the primary object of our invention to provide an aesthetically appealing supporting device which is capable of surrounding an easy chair and providing adequate support for such an encumbered individual when arising therefrom. It is also the specific object of our invention to provide such a support which functions as a fulcrum disposed ahead of the user's body, such that the user may bear against, and pivot about, the fulcrum support as the center of gravity of his or her body moves during the act of rising from the chair.

BRIEF SUMMARY OF THE INVENTION

Our fulcrum support aid, which has been designed for aiding the physically handicapped, elderly and childbearing women in arising from conventional easy chairs, is generally comprised of a rectangular shaped frame having a pair of front corner posts and a pair of rear corner posts, all of which are slidably interconnected by a plurality of slide bars. Each slide bar has male and female inter-engaging portions which are slidably extensible in relation to each other. Such inter-engaging portions have communicating slots extending transversely therethrough which are adapted to receive a conventional locking means. The generally rectangular shaped frame is constructed with the front slide bar sufficiently low such that the frame can be positioned around and sufficiently close to an easy chair so as not to interfere with the user thereof.

Each rear corner post and associated front corner post are interconnected at the top end thereof with an extensible fulcrum support member. The ends of each extensible fulcrum support are connected to corner brackets which are height adjustably connected to the front and rear corner post with which they are associated. In this respect, each fulcrum support is extensible lengthwise and capable of being adjusted upwardly and downwardly along its associated front and rear corner post. Thus, the adjustable slide bars and fulcrum support members of the frame make it possible to readily adjust the frame in three dimensions.

The top surface of each fulcrum support provides the user of the easy chair with a bearing surface against which he or she may bear and grasp for aid in arising therefrom. Each fulcrum support member is designed such that, with proper positioning and adjustment of the frame, it will be disposed directly adjacent and substantially at the same level as one of the armrests of the easy chair. The top surface of each fulcrum support member extends outwardly from and forwardly in front of its associated armrest. The forward-most portion of each fulcrum support member, which is disposed directly ahead of the front end of its associated armrest, carries an arcuately shaped grip portion which the user may grasp when pulling himself or herself from the chair. The extension of each fulcrum support member outwardly and forwardly of its associated armrest provides a broadened surface which the user of the chair may bear against with his or her arms and hands to enable such person to rise from the chair with relative ease.

As mentioned above, our three-dimensionally adjustable fulcrum support aid is primarily designed for use with easy chairs having shortened or abbreviated armrests, but is easily adjustable for use with easy chairs having longer armrests.

BRIEF DESCRIPTION OF THE DRAWINGS

These and other objects and advantages of the invention will more fully appear from the following description, made in connection with the accompanying drawings, wherein like reference characters refer to the same or similar parts throughout the several views, and in which.

DETAILED DESCRIPTION OF THE INVENTION

Figure 1A:
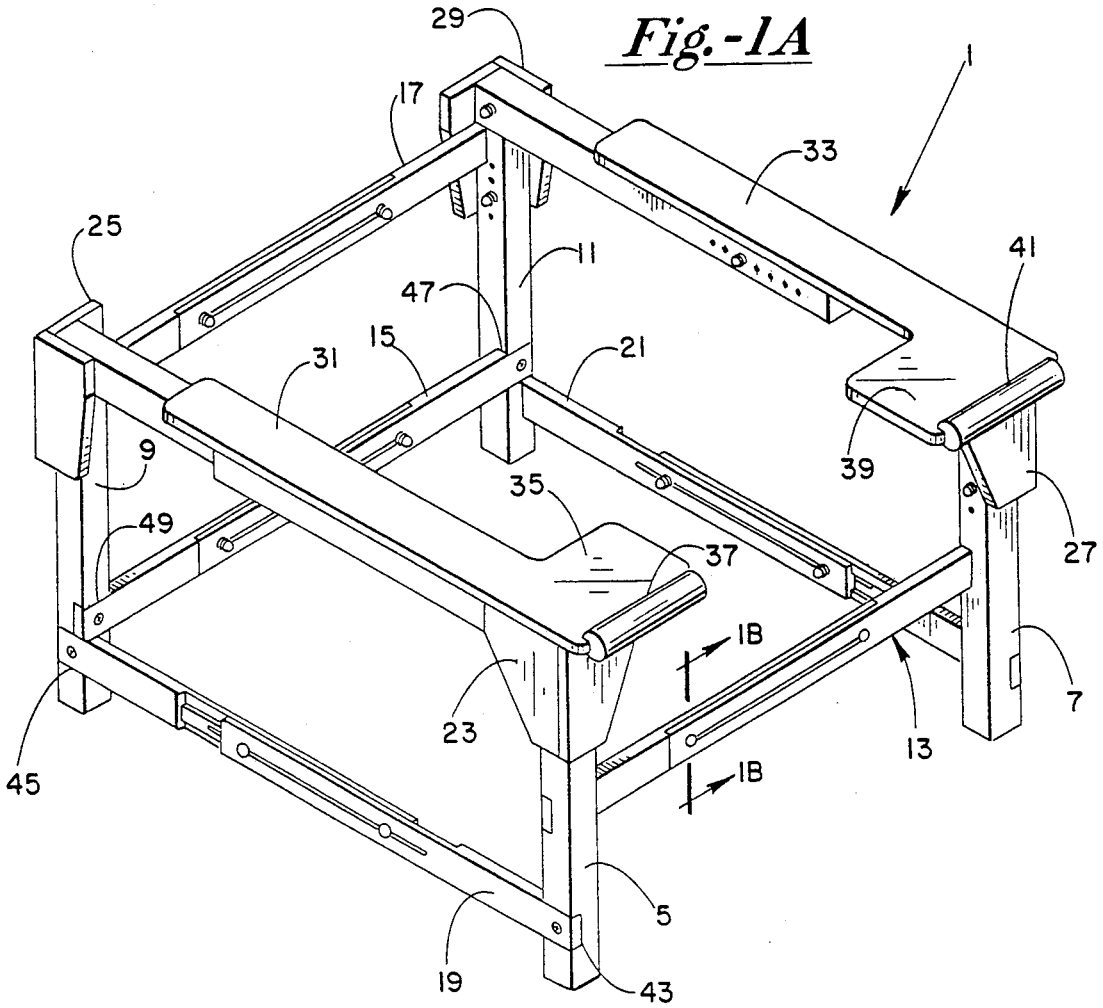
FIG. 1A is a perspective view of our adjustable fulcrum support aid, showing the unit as assembled.

As shown in FIG. 1A, our three-dimensionally adjustable fulcrum support aid for easy chairs is generally comprised of a rectangular shaped frame 1 within which a conventional easy chair or arm chair 3 may be positioned. As indicated previously, our adjustable support aid is adapted primarily for use with easy chairs 3 having abbreviated armrests 2 and 4, such as that shown in FIG. 2. However, as is readily apparent, our adjustable support aid may also be used with easy chairs which are not designed and constructed with such abbreviated armrests.

Referring now specifically to FIG. 1A, the generally rectangular shaped frame member 1 includes four corner posts, two front corner posts 5 and 7, and two rear corner posts 9 and 11. The two front corner posts 5 and 7 are spaced by a rigid front slide bar 13, which is connected at its ends to said front corner posts 5 and 7, and is extensibly adjustable.

Rear corner posts 9 and 11 are spaced by rigid rear slide bars 15 and 17, which are connected at their respective ends to said rear corner posts 9 and 11. Rear slide bars 15 and 17 are also extensibly adjustable in a similar manner to front slide bar 13. By adjustment of the front and rear slide bars, the width of the entire frame 1 may be adjusted.

Each associated front and rear corner post are also rigidly connected by a rigid side slide bar to provide adjustment of the frame 1 in the lengthwise direction between said front and rear corner posts. More specifically, front corner post 5 and rear corner post 9 are interconnected by means of rigid lower slide bar 19, which is extensibly adjustable in a similar manner to those slide bars previously mentioned. Similarly, front corner post 7 and rear corner post 11 are interconnected by means of rigid lower slide bar 21, which is also extensibly adjustable.

Each front corner post 5 and 7, and their respective associated rear corner post 9 and 11, carry a height adjustable corner bracket at the top end thereof. Front corner post 5, and its associated rear corner post 9, carry corner brackets 23 and 25, respectively. Front corner post 7, and its associated rear corner post 11, carry corner brackets 27 and 29, respectively. Extending between corner brackets 23 and 25, and fixedly connected thereto, is a lengthwise extensibly adjustable fulcrum support member 31. A second lengthwise extensibly adjustable fulcrum support member 33 extends between and is fixedly connected to corner brackets 27 and 29.

Figure 4:
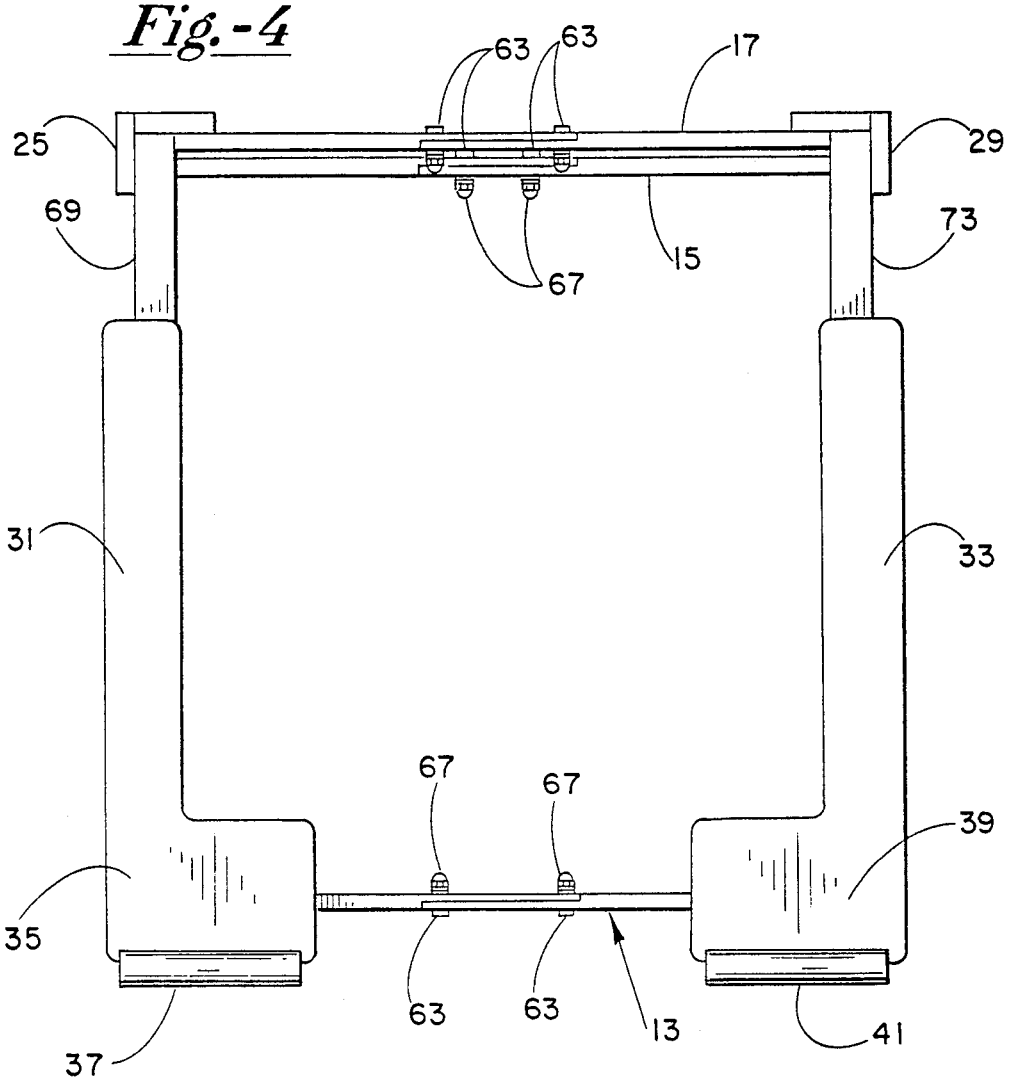
FIG. 4 is a top plan view thereof.
Figure 5:
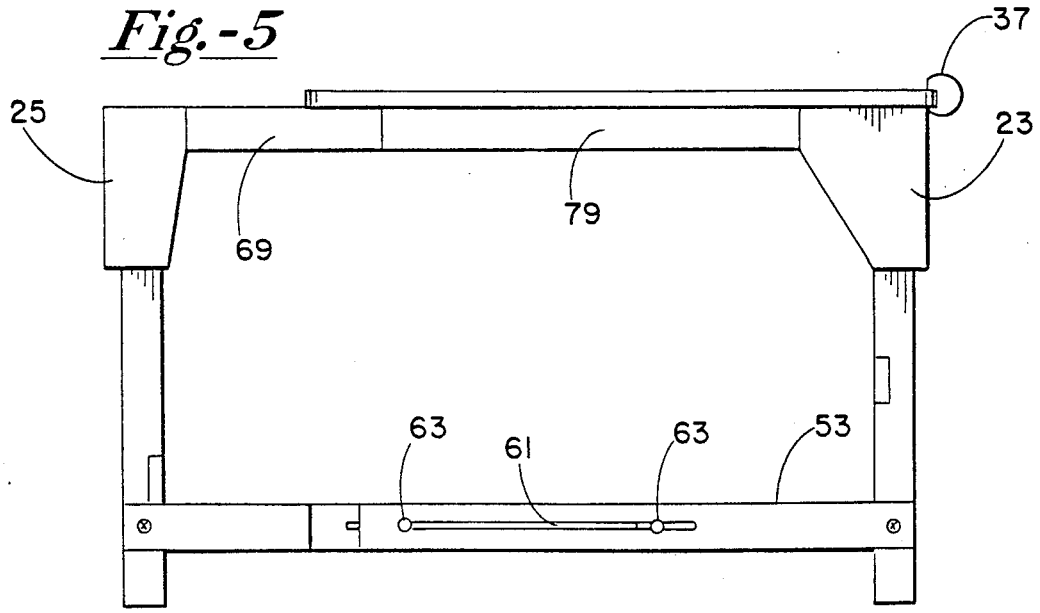
FIG. 5 is a side elevational view thereof.

As best seen in FIG. 4 and FIG. 5, fulcrum support member 31 has a broadened front end portion 35 which overhangs the front face of corner bracket 23 and carries a rounded or arcuate grip 37. Similarly, fulcrum support member 33 has a broadened front end portion 39 which overhangs the front surface of corner bracket 27 and carries an arcuate grip 41. Broadened portions 35 and 39, and grips 37 and 41 enable the user of our easy chair support aid to grasp the fulcrum support members 31 and 33 at a position near or ahead of his or her center of gravity to aid in arising from the chair.

Figure 2:
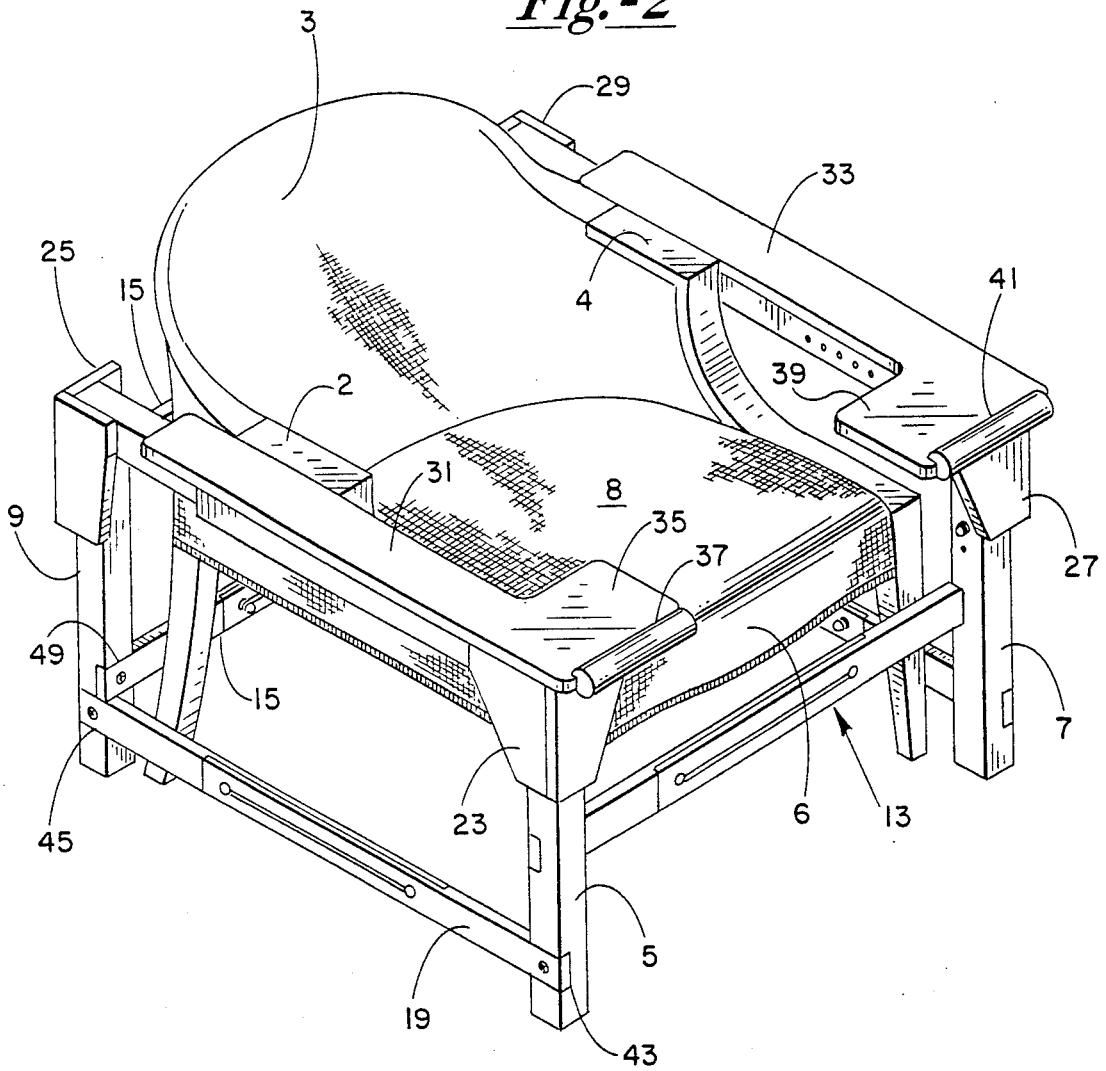
FIG. 2 is a perspective view showing our adjustable fulcrum support aid as used in connection with an easy chair.

As shown in FIG. 2, when properly positioned, the frame unit 1 is adjusted by length, width, and height so that each fulcrum support member 31 and 33 lie in substantially the same horizontal plane as the respective armrests 2 and 4 of the easy chair 3 which it surrounds. Front slide bar 13, which adjustably interconnects front corner posts 5 and 7, is connected to such corner posts at the central portion thereof to assure that said front slide bar 13 does not obstruct the legs of the user of easy chair 3.

As can be seen best in FIG. 1A, for purposes of providing aesthetic appeal as well as enhancing the strength of frame unit 1, each corner post of said frame 1 has recessed or channeled portions which are designed to receive the associated slide bars therein for firm connection to and support thereby. By way of example, slide bar 19, which extends between front corner post 5 and rear corner post 9, is received within recessed portion 43 in front corner post 5, and within recessed portion 45 in rear corner post 9. The outer surface of slide bar 19 lies substantially flush with the outer surface of front and rear corner posts 5 and 9.

Similarly, one end of rear slide bar 15 is received within the recessed portion 47 in rear corner post 11. The other end of rear slide bar 15 is received within the recessed portion 49 in rear corner post 9. Each of the remaining slide bars 13, 17, and 21 are also received and fixedly secured within similar recessed portions in their associated corner posts. By constructing the frame in such manner, the strength of the slide bars are greatly enhanced while at the same time providing an aesthetically appealing frame unit 1 for the user thereof. To further enhance the aesthetic appeal of frame unit 1, it is constructed of solid wood and given an appropriate finish.

Figure 1B:
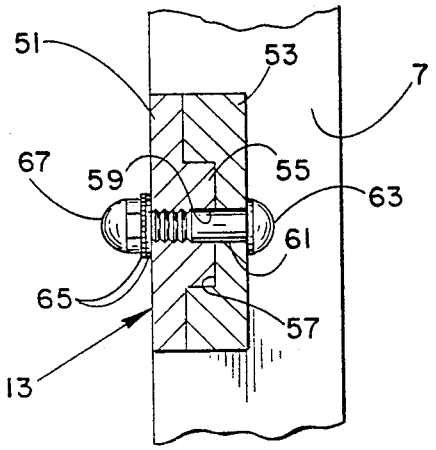
FIG. 1B is a fragmentary vertical sectional view of the front slide bar of our adjustable fulcrum support aid, taken along line 1B—1B of FIG. 1A.
Figure 3:
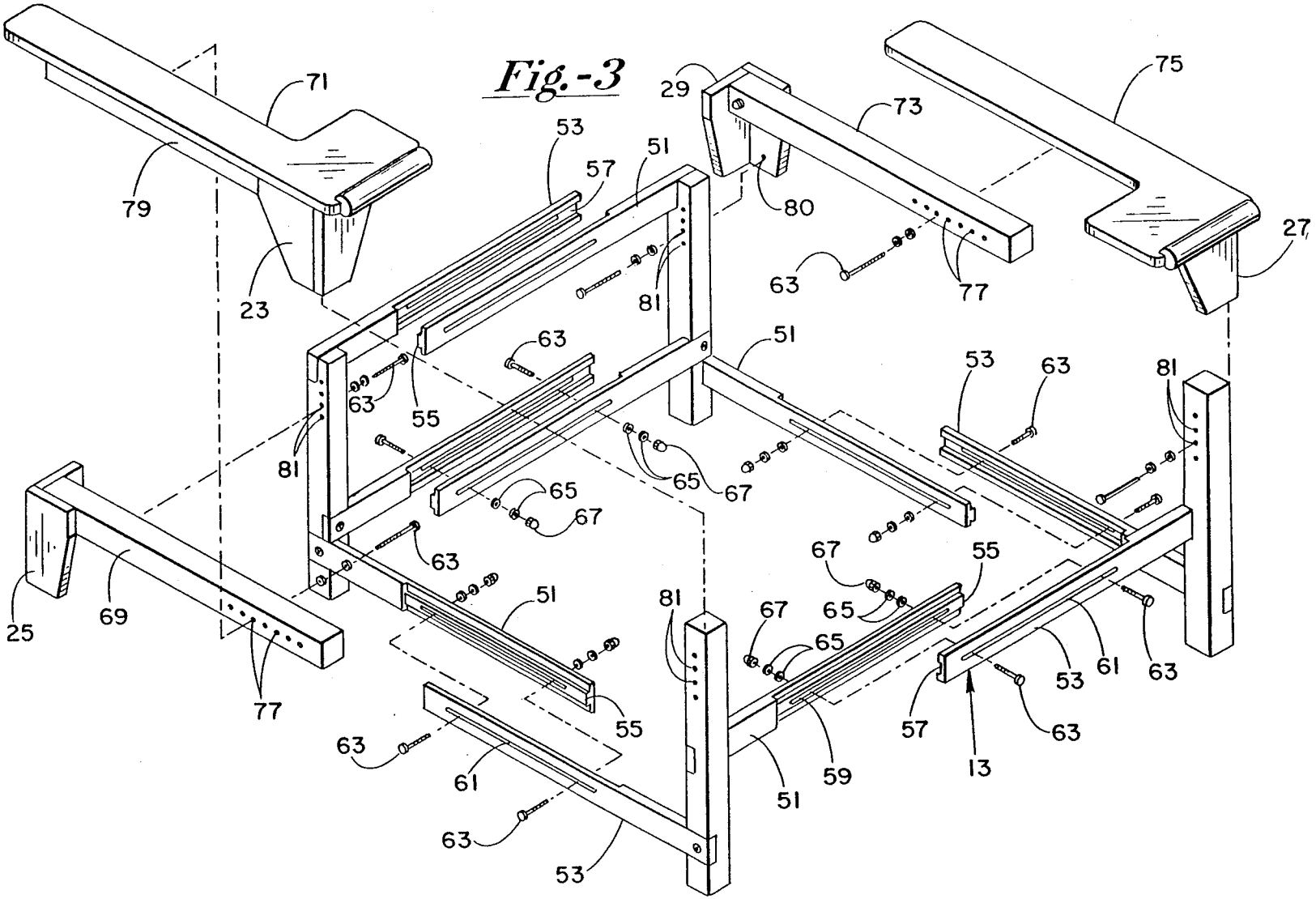
FIG. 3 is an exploded view of our adjustable fulcrum support aid, showing the construction thereof.

Referring now to FIG. 3, a more detailed discussion of the construction of the various parts associated with our adjustable easy chair support aid can be provided. As shown therein, and as shown in FIG. 1B, each slide bar member is comprised of a pair of slidable, inter-engaging, male and female portions 51 and 53, respectively. Since each slide bar member is constructed and slidably extensible in an identical manner, the following discussion will relate to only one such slide bar, it being understood that the construction and function of each is the same.

Front slide bar 13 includes slidably mating male and female portions 51 and 53, respectively. Elongated slide member 51 includes a centrally disposed outwardly extending protrusion 55 which overlaps and cooperatively mates in slidable inter-engaging relation with the central elongated channel portion 57 of slide member 53.

Slide member 51 includes an elongated slot which extends transversely therethrough along the center line of protrusion 55. Female slide member 53 includes an associated elongated slot extending transversely therethrough along the center line of its associated channel 57. Such elongated slots extending through male slide member 51 and female slide member 53 communicate with one another when such slide members are disposed in inter-engaging relation, as shown in FIG. 1B.

Bolts 63 extend through the communicating slots 59 and 61 and receive associated washers 65 and securing nuts 67 to lock the male slide member 51 and female slide member 53 together in secure relation, once proper adjustment thereof has been made to suit the specific easy chair 3 around which the frame unit 1 is disposed. In a similar manner, each of the other slide bars may be readily adjusted and secured in a predetermined position for suitable use with any given easy chair 3.

As can be seen in FIG. 3, fulcrum support member 31 is comprised of an elongated adjustment bar 69 and a fulcrum 71 which connect in an adjustable manner so as to be longitudinally extensible. Similarly, fulcrum support member 33 is comprised of adjustment bar 73 and fulcrum 75, which are also adjustably connected so as to be longitudinally extensible. Each adjustment bar 69 and 73 includes a plurality of longitudinally spaced transverse openings 77 which are adapted to receive a conventional bolt 63 therethrough. Each fulcrum 71 and 75 includes a depending portion 79 which carries an internally threaded zinc cast insert (not shown) which is properly orientated and disposed so as to communicate with openings 77 in respective adjustment bars 69 and 73. With proper alignment, a conventional bolt 63, which carries washers 65, extends through one of the openings 77 in each adjustment bar 69 and 73, and thereafter threads into the respective internally threaded zinc cast insert carried by the associated fulcrum 71 or 75. By this means, once frame 1 has been properly adjusted for suitable use with an easy chair 3, each fulcrum can be fixedly secured in its proper position.

In order to properly adjust the height of each fulcrum support member 31 and 33, each support member is fixedly secured to a pair of associated front and rear corner brackets which are height adjustably connected to their associated front and rear corner post. More specifically, the adjustment bar 69 of fulcrum support member 31 is fixedly secured to the upper portion of rear corner bracket 25. The associated fulcrum 71 is fixedly secured to front corner bracket 23. Each corner bracket 23 and 25 carries an internally threaded zinc cast insert 80, similiar to that shown in corner bracket 29, which is orientated such that it is capable of being aligned in communicating relation with one of the openings 81 in the upper portion of the corner post to which it attaches. After corner brackets 23 and 25 are adjusted so as to properly position fulcrum support member 31 in substantially the same horizontal plane of armrest 2 of easy chair 3, conventional bolts 63 may be inserted through the corresponding openings 81 in front and rear corner posts 5 and 9, and thread into the zinc cast inserts in the associated corner brackets 23 and 25.

Fulcrum support member 33 is also similarly height adjustable in that adjustment bar 73, and fulcrum 75, are fixedly secured to rear corner bracket 29 and front corner bracket 27, respectively. Each corner bracket 27 and 29 also carries an internally threaded zinc cast insert 80, which is designed to adjustably align with one of the plurality of openings 81 in the upper-most portion of front corner post 7 and rear corner post 11. After proper adjustment of fulcrum support member 33, such that it lies in substantially the same horizontal plane as armrest 4 of easy chair 3, a conventional bolt 63 may be received through a communicating opening 81 into the zinc cast insert 80 in each associated corner bracket, thereby fixedly securing fulcrum support member 33 in its proper position.

The operation of our adjustable fulcrum support aid is best seen from FIG. 2. Through proper height adjustment of each corner bracket 23 and 25, fulcrum support member 31 is disposed in substantially the same horizontal plane as armrest 2. Similarly, fulcrum support member 33 is height adjustable so as to be disposed in substantially the same horizontal plane as armrest 4. The width of frame 1 is readily adjustable by means of proper adjustment of front slide bar 13 and rear slide bars 15 and 17. The entire frame unit 1 can be moved inwardly and outwardly to properly position fulcrum support members 31 and 33 closely adjacent to their respective armrest 2 and 4 of easy chair 3. Once proper adjustment is made, the front and rear slide bars may be fixedly secured via the use of conventional bolts 63 and nuts 67.

The length of frame unit 1 may be properly adjusted via slide bars 19 and 21, such that the front slide bar 13 and rear slide bars 15 and 17 are disposed closely adjacent to the front-most and rearmost portion of easy chair 3. Proper adjustment to position front slide bar 13 closely adjacent to the front end of easy chair 3 is important to avoid obstruction of the user's legs thereby. Front slide bar 13 is also positioned near the center of front corner posts 5 and 7 so that it is low enough to avoid obstruction of the user's legs.

Upon proper adjustment of the frame unit 1, a user of easy chair 3 may readily arise therefrom with relative ease through the use of our adjustable fulcrum support aid. It is noted that each fulcrum support member 31 and 33 are adjusted such that their broadened front end bearing surfaces 35 and 39, respectively, are disposed immediately ahead of the front end 6 of the seat cushion 8 of easy chair 3, and extend across in front of the front end of each associated armrest 2 and 4. Such positioning of each fulcrum support member allows the user of the easy chair 3 to easily grasp grips 37 and 41 of each bearing surface 35 and 39 at a point immediately above the user's feet. Since the user's center of gravity will shift to an axis through the user's feet as he or she arises from the chair, each fulcrum support member provides a fulcrum at or near such axis against which the user may bear and grasp when pulling himself or herself from the chair. As is readily seen in FIG. 2, each fulcrum support member 31 and 33 also expands laterally outward from each armrest so as to provide a broadened area on which the user may rest their arms.

With the use of our three-dimensionally adjustable fulcrum support aid, encumbered individuals such as the handicapped, elderly and childbearing women may arise from conventional easy chairs having shortened armrests with relative ease. As can be seen from FIG. 2, however, it is apparent that our adjustable fulcrum support aid may also function equally well and provide enhanced support in cases were the armrests of the easy chair are not abbreviated.

It will, of course, be understood that various changes may be made in the form, details, arrangement and proportions of the parts without departing from the scope of the invention which is comprised of the matter shown and described herein and set forth in the appended claims.

We claim:

1. A three-dimensionally adjustable support device for assisting a user in arising from an easy chair having shortened armrests, comprising:

(a) an easy chair having a pair of generally horizontally disposed armrests which are abbreviated in length;

(b) a three-dimensionally adjustable frame encircling said easy chair about a horizontal plane, said frame including a plurality of upstanding corner posts interconnected by slidably adjustable slide bars to form a closed substantially rectangular structure; and (c) a pair of fulcrum supports carried by said frame, each of said supports being disposed adjacent one of said armrests of said easy chair, and being positioned outwardly therefrom in substantially the same general plane as said adjacent armrest so as to provide a fulcrum about which the user may pivot when arising from said easy chair.

2. The structure defined in claim 1, wherein each of said adjustable slide bars comprises separate male and female inter-engaging portions which slidably interconnect to form said slide bar.

3. The structure defined in claim 1, wherein each of said slide bars comprises a pair of elongated slidably mating juxtaposed portions, each of which has an elongated transverse slot extending therethrough which is disposed in communicating relation with said slot of said adjacent mating position, said communicating slots of said adjacent mating portions being adapted to receive a readily releasable locking means therethrough to secure said mating portions together.

4. The structure defined in claim 1, wherein said fulcrum supports extend laterally outwardly and forwardly of said abbreviated armrests of said easy chair.

5. The structure defined in claim 1, wherein each of said armrests has a terminating front end portion and each of said fulcrum supports includes a broadened front end grip portion which extends outwardly from and across in front of said front end portion of said adjacent armrest.

6. The structure defined in claim 1, wherein said frame and fulcrum supports are constructed as a finished wood product.

7. The structure defined in claim 1, wherein each of said upstanding corner posts has laterally extending channeled portions which are constructed and arranged to receive therewithin end portions of said slide bars which extend therebetween.

8. The structure defined in claim 1, wherein each of said fulcrum supports is connected to a pair of corner brackets which are each height adjustably connected to one of said corner posts.

9. The structure defined in claim 1, wherein each of said fulcrum supports includes a front end grip portion which carries an arcuate hand grip for aiding the user in arising from said chair.

10. A three-dimensionally adjustable support device for assisting a user in arising from an easy chair having abbreviated armrests, comprising:

(a) an easy chair having a pair of side armrests which are abbreviated in length between their front and rear ends:

(b) a frame surrounding said chair in close proximity thereto, said frame being readily adjustable in three dimensions; and (c) a pair of fulcrum support members connected to the upper portion of said frame and movable via vertical and horizontal adjustment of said frame, each of said support members being disposed adjacent one of said armrests, of said chair and being positioned outwardly from and across in front of the front end of said adjacent armrest, thereby providing a fulcrum bearing surface in substantially the same general plane as said adjacent armrest which the user of said chair can grip for support in arising therefrom.

11. The structure defined in claim 10, wherein said adjustable frame includes a plurality of upstanding corner posts interconnected by adjustable slide bars, each of said slide bars having slidably mating adjacent extension members which are constructed and arranged to be lockably secured together in a predetermined desired position.

12. The structure defined in claim 11, wherein each of said slidable mating extension members includes an elongated transverse slot which communicates with said slot of its adjacent mating portion so as to receive a locking means therethrough which is slidably adjustable.

13. The structure defined in claim 11, wherein each of said upstanding posts includes recessed portions, said corner posts being constructed and arranged to receive within said recessed portions the ends of said slide bars which extend therebetween.

14. The structure defined in claim 10, wherein said fulcrum bearing surface of each said fulcrum support includes an arcuately shaped hand grip at the front-most portion thereof for aiding the user in arising from said chair.

15. The structure defined in claim 10, wherein said bearing surface of each said fulcrum support is broader than the remaining portion thereof, and is disposed in front of the front end of said armrest with which it is adjacent.

16. A three-dimensionally adjustable support device for a user who is arising from an arm chair having abbreviated armrests, comprising:

(a) a substantially rectangular shaped closed frame which is adjustable in three dimensions, said frame including a plurality of upstanding corner posts which are interconnected by slidably adjustable slide bars, said frame receiving the entire arm chair within its closed rectangular confines; and (b) a pair of fulcrum supports connected to the upper portion of said frame and movable via vertical and horizontal adjustment of said frame, each of said fulcrum supports having a broadened front end grip portion which extends toward said other fulcrum support, each said grip portion providing a fulcrum about which the user of the armchair may pivot when arising therefrom.

17. The structure defined in claim 16, wherein each of said slide bars comprises a pair of slidably inter-engaging members which are readily lockable at a predetermined desired position, one of said inter-engaging members having an elongated channel portion which slidably receives a mating elongated tongue portion of said other inter-engaging member.

18. The structure defined in claim 17, wherein said inter-engaging members of each of said slide bars have communicating transverse slots therethrough which extend longitudinally along the length thereof, said slots being adapted to receive a readily releasable locking means therewithin for securing said inter-engaging members together.

19. The structure defined in claim 16, wherein said broadened front end grip portion of each of said fulcrum supports carries an arcuately shaped hand grip which aids the user of the arm chair in arising therefrom.

20. The structure defined in claim 16, wherein each of said corner posts includes a plurality of horizontally extending grooves which are constructed and arranged to receive therein the end portions of said slide bars extending therebetween, said slide bars being secured to said corner posts within said grooves thereof.

21. A three-dimensionally adjustable support device for assisting a user in arising from an easy chair having shortened armrests, comprising:

(a) an easy chair having a pair of generally horizontally disposed armrests which are abbreviated in length;

(b) a three-dimensionally adjustable frame surrounding said easy chair, said frame including a plurality of upstanding corner posts interconnected by slidably adjustable slide bars to form a closed substantially rectangular structure;

(c) a pair of fulcrum supports carried by said frame, each of said supports being disposed adjacent one of said armrests of said easy chair, and being positioned outwardly therefrom in substantially the same general plane as said adjacent armrest thereby providing a fulcrum about which the user may pivot when arising from said easy chair; and (d) each of said armrests having a terminating front end portion and each of said fulcrum supports including a broadened front end grip portion which extends outwardly from and across in front of said front end portion of said adjacent armrest.

* * * * *